US008442253B2

(12) United States Patent
Finlay

(10) Patent No.: US 8,442,253 B2
(45) Date of Patent: May 14, 2013

(54) HEARING AID

(75) Inventor: Barry Finlay, Pocatello, ID (US)

(73) Assignee: Brainstorm Audio, LLC, Dover, DE (US)

( * ) Notice: Subject to any disclaimer, the term of this patent is extended or adjusted under 35 U.S.C. 154(b) by 0 days.

(21) Appl. No.: 13/354,834

(22) Filed: Jan. 20, 2012

(65) Prior Publication Data

US 2012/0189149 A1 Jul. 26, 2012

Related U.S. Application Data

(60) Provisional application No. 61/436,312, filed on Jan. 26, 2011.

(51) Int. Cl.
*H04R 25/00* (2006.01)

(52) U.S. Cl.
USPC ..... 381/328; 381/322; 381/330

(58) Field of Classification Search ..... 381/322, 381/324, 325, 326, 328, 330, 380, 381, 382; 379/430; 607/56, 57; 181/129, 130, 135
See application file for complete search history.

(56) References Cited

U.S. PATENT DOCUMENTS

| | | | | |
|---|---|---|---|---|
| 4,727,582 | A * | 2/1988 | de Vries et al. | 381/330 |
| 5,185,802 | A | 2/1993 | Stanton | |
| 5,606,621 | A | 2/1997 | Reiter et al. | |
| 6,137,889 | A | 10/2000 | Shennib et al. | |
| 6,216,040 | B1 | 4/2001 | Harrison | |
| 6,937,738 | B2 | 8/2005 | Armstrong et al. | |
| 7,027,608 | B2 * | 4/2006 | Fretz et al. | 381/330 |
| 7,110,562 | B1 | 9/2006 | Feeley et al. | |
| 7,113,611 | B2 | 9/2006 | Leedom et al. | |
| 7,130,437 | B2 | 10/2006 | Stonikas et al. | |
| 7,139,404 | B2 * | 11/2006 | Feeley et al. | 381/330 |
| 7,403,629 | B1 | 7/2008 | Aceti et al. | |
| 7,684,579 | B2 | 3/2010 | Ochsenbein et al. | |
| 7,844,065 | B2 | 11/2010 | Von Dombrowski | |
| 2006/0210104 | A1 | 9/2006 | Shennib et al. | |
| 2007/0071265 | A1 | 3/2007 | Leedom et al. | |
| 2007/0127757 | A2 | 6/2007 | Darbut et al. | |
| 2008/0181440 | A1 | 7/2008 | Saltykov | |
| 2008/0260191 | A1 | 10/2008 | Victorian et al. | |

(Continued)

FOREIGN PATENT DOCUMENTS

| | | |
|---|---|---|
| WO | 2008/095489 | 8/2008 |
| WO | WO 2010/114981 | 10/2010 |

OTHER PUBLICATIONS

PCT/US2012/022411 Written Opinion of the International Searching Authority, dated May 29, 2012 (8 pages).

(Continued)

*Primary Examiner* — Huyen D Le
(74) *Attorney, Agent, or Firm* — Workman Nydegger

(57) ABSTRACT

A hearing aid of the present invention is convenient to repair and replace. The hearing aid includes: (i) an out-of-canal assembly comprising a power source (e.g., a battery) and a processor, and (ii) an in-canal assembly comprising a microphone and a receiver. The out-of-canal assembly is selectively, removably, electrically coupled to the in-canal assembly. Sound perceived by the in-canal assembly is processed by the out-of-canal assembly and transmitted to the user's eardrum. The in-canal assembly is conveniently, selectively decoupled from the out-of-canal assembly for convenient replacement or repair.

22 Claims, 5 Drawing Sheets

U.S. PATENT DOCUMENTS

| | | | |
|---|---|---|---|
| 2009/0034765 | A1 | 2/2009 | Boillot et al. |
| 2009/0129619 | A1 | 5/2009 | Nordahn |
| 2009/0136070 | A1 | 5/2009 | Koo |
| 2009/0262964 | A1 | 10/2009 | Havenith et al. |
| 2009/0316940 | A1 | 12/2009 | Pander et al. |
| 2010/0092016 | A1 | 4/2010 | Iwano et al. |
| 2010/0150385 | A1 | 6/2010 | Sporer |
| 2011/0166680 | A1 | 7/2011 | Pander et al. |
| 2011/0299709 | A1 | 12/2011 | Anderson et al. |

OTHER PUBLICATIONS

Anderson et al., *High Frequencies and Microphone Placement Lead to a New Type of RIC Hearing Aid*, Hearing Review, Apr. 2011, 7 pages.

Parade Magazine, Oct. 23, 2011, p. 9, "The Sound Amplifier that is disguised as a cell phone headset!"

"Bose Corporation" Wikipedia, http://en.wikipedia.org/wiki/Bose_Corporation, printed Apr. 25, 2012, 11 pages.

* cited by examiner

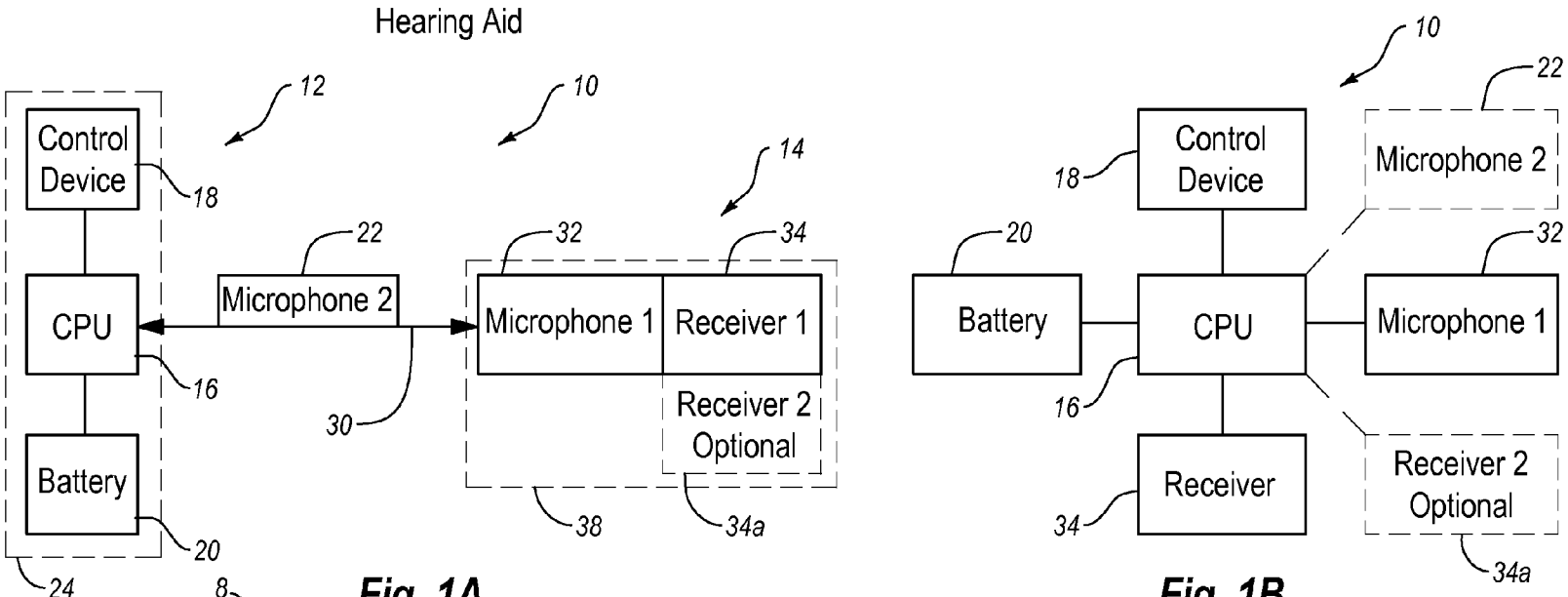
Fig. 1A
Fig. 1B
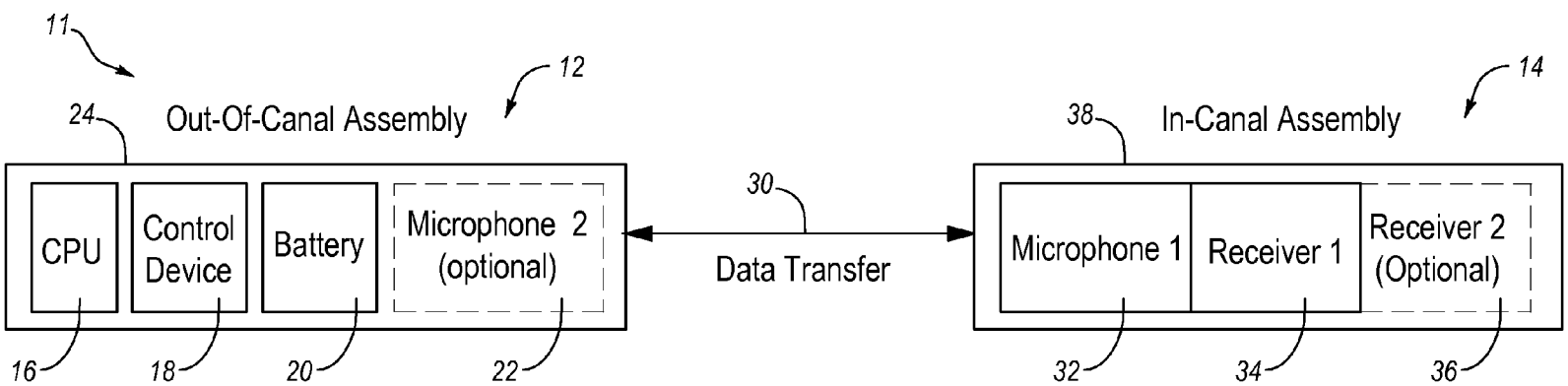
Fig. 1C

HEARING AID

RELATED APPLICATION

This non-provisional patent application claims priority to and the benefit of U.S. provisional patent application No. 61/436,312, filed on Jan. 26, 2011, entitled Hearing Aid, to Barry D. Finlay, which is incorporated herein in its entirety by reference.

BACKGROUND OF THE INVENTION

1. The Field of the Invention

This invention is in the field of hearing aids and other listening devices.

2. The Relevant Technology

Hearing aid devices have become of great assistance to the hearing impaired. For decades, the hearing-impaired have been using electronic hearing aid devices that fit either within the ear canal or partially within the ear canal and partially outside the ear canal. The portion of a hearing device that fits within the ear canal and even the portion of the hearing aid device that is outside the ear canal is typically subject to damage from the environment and from the oils, acids, waxes, and perspiration from a user's body. As a result, it is common to replace parts and to require expensive warranties to maintain typical hearing aids.

What is needed is a hearing aid that is inexpensive to maintain, that has parts that are convenient to repair and replace, and that is inexpensive and convenient for a user to use and manage in daily use.

BRIEF SUMMARY OF THE INVENTION

A hearing aid of the present invention is convenient to repair and replace. The hearing aid comprises: (i) an out-of-canal assembly (i.e., out of ear canal assembly) comprising a power source (e.g., a battery) and a processor, and (ii) an in-canal assembly (i.e., in-ear canal assembly) comprising a microphone and a receiver (i.e., a speaker). The out-of-canal assembly is selectively, removably, electrically coupled to the in-canal assembly. Sound perceived by the in-canal assembly is processed by the out-of-canal assembly and transmitted back to the user's eardrum. The in-canal assembly is conveniently, selectively decoupled from the out-of-canal assembly for convenient replacement or repair.

Since the in-canal assembly is removably, electronically coupled to the out-of-canal assembly, the in-canal assembly is readily replaceable. The ability to replace the in-canal assembly provides many advantages from a technological, economic and convenience standpoint. The in-canal assembly comprises the components, e.g. the receiver and microphone, that are the most commonly subjected to wear, damage, and malfunction due to wax, oils, and fluids associated with the user's ear canal. Openings for the microphone and receiver are present in the in-canal assembly. The out-of-canal assembly, however, can be configured to be sealed so as to prevent fluids and other potential damaging elements from affecting the electrical components of the assembly. By separately connecting the in-canal assembly to the out-of-canal assembly, the user is typically only required to replace the in-canal assembly when any damage occurs.

For example, in one embodiment, a hearing aid is sold with one out-of-canal assembly and with multiple e.g. 2, 3, 4, or 5 in-canal assemblies so that replacement of the in-canal assembly is convenient when damage or wear occurs. This also makes warranty treatment convenient in the event that the in-canal assembly needs to be mailed to an out of town facility for repair or replacement.

The word "receiver," as referred to herein, refers to a speaker that emits sound therefrom.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which:

FIG. 1A is a schematic, functional view of a hearing aid of the present invention, the hearing aid comprising (i) an out-of-canal assembly 12; and (ii) an in-canal assembly 14.

FIG. 1B is an example of a possible wiring diagram of the hearing aid of FIG. 1A. In one embodiment, the communication between the various devices of the present invention is provided in a wireless, e.g., Bluetooth, format as opposed to via a physical wired connection.

FIG. 1C is another schematic, functional view of an alternative hearing aid of the present invention.

DETAILED DESCRIPTION OF THE PREFERRED EMBODIMENTS

Figure 2:
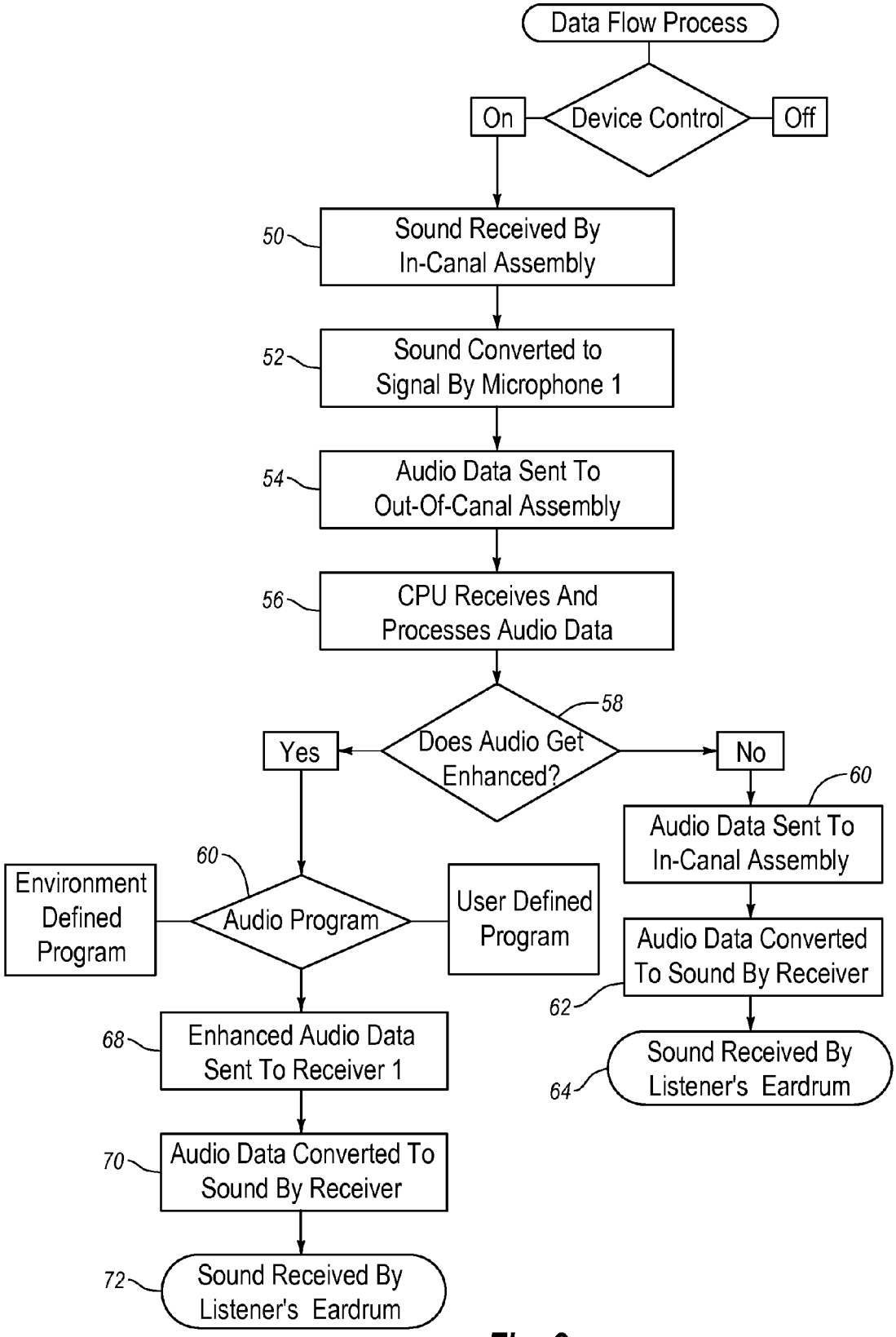
FIG. 2 represents a functional flow diagram that describes the process of sound as it flows from the environment through the hearing aid of FIGS. 1A-1B, for example.

FIG. 1A is a functional representation of a hearing aid 10 of the present invention. Hearing aid 10 is comprised of out-of-canal assembly 12 and in-canal assembly 14, which is electronically coupled to out-of-canal assembly 12. Out-of-canal assembly 12 is comprised of: (i) a central processing unit 16, such as an amplifier or other processing device that processes information and data necessary for the functioning of the hearing aid; (ii) a control device 18, such as a rotatable volume setting device, a series of buttons (or optionally a remote control device or software application on a cell phone, for example); (iii) a power source such as a battery 20 for providing power to the central processing unit 16 and any other components that need electrical power.

Various components of out-of-canal assembly 12 are housed by a housing 24. Thus, CPU 16, control device 18, and battery 20, may be housed within or on a housing 24. Optionally, an alternative control device is located separately from housing 24, for example, in a remote device, e.g., a remote control, cell phone software application, etc.

Out-of-canal assembly 12 is selectively, removably, electrically coupled to in-canal assembly 14 through an electrical cord 30 that enables electrical communication between out-of-canal assembly 12 and in-canal assembly 14. In-canal assembly 14 is comprised of a microphone 32, a receiver 34, and an optional additional receiver 36 housed by, e.g., within, a housing 38. Microphone 32 is used as a microphone that initially receives sounds that are ultimately heard by a user, while receiver 34 is a speaker that ultimately emits sounds that are heard by a user.

As shown, hearing aid 10 has a secondary microphone 22 that is used for noise cancellation or other audio enhancement purposes, and is located on electrical cord 30, as will be discussed in connection with FIG. 3 below. In one embodiment, microphone 22 is located separately from housing 24 or housing 38. Microphone 22 may be used for noise cancellation purposes, for example, or to otherwise modify or adjust the sound that is heard by a user. Microphone 22 can be configured to receive sound for directional purposes, e.g., to focus the sound into a desired polar pattern, resulting in audio enhancement.

FIG. 1B is an exemplary wiring diagram of the hearing aid 10 of FIG. 1A. FIG. 1C represents an alternative hearing aid 11 that is similar to hearing aid 10. In the embodiment of FIG. 1B, the optional second microphone 22 is part of or is located adjacent the out of canal assembly 12.

With reference now to FIGS. 1A, 1B, and FIG. 2, FIG. 2 reflects a data flow process relating to hearing aid 10, which will now be described in additional detail. As shown at step 50, if hearing aid 10 is in the on position, a sound is received by the in-canal assembly 14. The microphone 32, in the in-canal assembly 14 converts the sound to a signal as shown at step 52. Audio data is sent to the out-of-canal assembly 12 at step 54 through electrical cord 30, although a wireless (e.g., Bluetooth) connection may also be established. As shown in step 56, the central processing unit 16 receives and processes the audio data received from the in-canal assembly 14.

According to one embodiment, there are audio enhancements, such as additional microphones 22 used to cancel unwanted noise, and other devices and procedures employed to enhance the audio received. As shown at step 58, if the audio is not enhanced, the audio data processed by the central processing unit 16 is returned to the in-canal assembly 14, as further shown at step 60 and then is converted to sound by receiver 34 as further reflected in step 62, after which the sound is received by the listener's eardrum as reflected in step 64.

In the event that the audio is enhanced by noise cancelling devices, e.g., microphone 22, the CPU processed audio data is received by an audio program, as shown in step 60, which may be a user defined program or environment defined program. The sound is then sent to receiver 34 of the in-canal assembly 14 as shown at step 68 and then is converted to sound by receiver 34 as shown at step 70. As shown at step 72, the sound is then received by the listener's eardrum.

Figure 3:
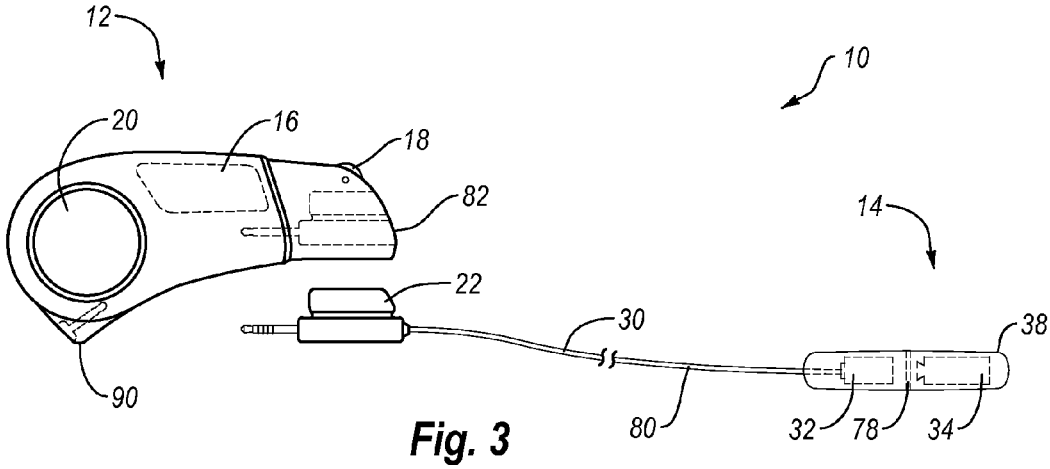
FIG. 3 is a depiction of the hearing aid of FIG. 1A.

FIG. 3 is a depiction of hearing aid 10 shown in an exemplary environment. Out-of-canal assembly 12 and in-canal assembly 14 are shown in exemplary housing depictions, although a variety of different housings are available for the components and functions described herein.

Out-of-canal assembly 12 comprises a central processing unit 16, a battery 20, and a control device 18, for example. Battery 20 is in electrical communication with processor 16. Battery 20 may optionally also be in direct communication with control device 18, and, when cord 30 is connected, microphone 32, microphone 22 and receiver 34 of in-canal assembly 14.

Control device 18 can be a button, a panel of buttons, a rotating volume control, or a variety of other control devices, for example. Optionally, a software application for example on an iphone, or other remote control may be employed as a control device.

As shown, electrical cord 30 connects in-canal assembly 14 to out-of-canal assembly 12, such that assembly 12 is in electrical communication with assembly 14. In-canal assembly 14 is comprised of microphone 32, a receiver 34, and housing 38 that houses microphone 32 and receiver 34.

As further shown in FIG. 3, microphone 32 is mounted within housing 38 so as to be closer to the opening of the ear while receiver 34 of in-canal assembly 14 is positioned within housing 38 so as to be closer to the ear canal and the ear drum. Furthermore, a partition 78 is located between receiver and microphone. This partition 78 enables sound exiting from receiver 34 to be bounced against partition 78 for enhancement of the quality of the reception of the sound to the listener's eardrum. The positioning of the opening of receiver 34 away from the ear drum and toward partition 78 also helps ensure that less moisture from the eardrum is deposited within receiver 34.

As shown in FIG. 3, the sound emitting opening of receiver 34 is turned away from the ear canal and toward the microphone 32 such that moisture and wax has a further path to move from the ear drum to be within an opening of receiver 34. The sound from receiver 34 reflects off partition 78 and then back to the user's eardrum. As shown, the opening of receiver 34 is positioned so as to be oriented toward the partition 78 and away from the ear canal during use of hearing aid 10. Because of such positioning, reflecting receiver 34 is more resilient to the environmental conditions of the ear, providing protection from wax and oils within the ear, which must travel a further path to infest the opening of the receiver port of receiver 34. Reflecting receiver 34 thus provides a smoother extended response.

Receiver 34 is a speaker and is an example of a direct reflecting receiver or direct reflecting transducer. The in-canal assembly 14 is at least partially sealed against the acids and other fluids that are inside the ear canal.

In one embodiment, housing 38 comprises a deformable material, such as a tubular metallic or plastic member that is deformable such that it can be placed in the ear canal and formed to the shape of the ear canal in a comfortable manner. The deformable material is, in one embodiment, covered by a custom molded silicone housing, for example. A fitted silicone mold may be mounted around the housing of the in-canal assembly 14 to comfortably fit within the ear of the user. In one embodiment, cord 30 is permanently coupled to in-canal assembly 14 and extends from in-canal assembly 14 to be selectively, removably coupled to out-of-canal assembly 12 as reflected in FIG. 3. Cord 30 is optionally selectively coupled to in-canal assembly 14.

Figure 3A:
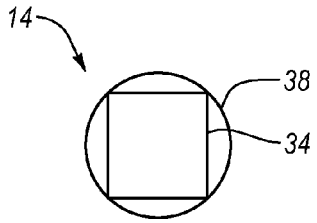
FIG. 3A is a depiction of a rear view of the in-canal assembly of FIG. 3, showing the receiver (speaker) surrounded by the housing.

Apertures are located in the front and the rear portion of assembly 14 such that sound can be received from the environment into microphone 32 and exit receiver 34 into the ear drum. FIG. 3A shows a depiction of an embodiment of a rear view of assembly 14, reflecting that the housing 38 at the rear end (to be pointed toward the ear drum) of assembly 14 may be circular in cross section, while the rear end of the receiver 34 is square, thereby allowing sound to be emitted around the edges of square receiver 34 into the ear drum.

Various options can be employed for providing a housing that surrounds the receiver and/or microphone of the in-canal assembly 14. For example, as illustrated in FIG. 3A, in one embodiment, the housing 38 is a tubular member having a circular cross section while the receiver 34 has a square or rectangular cross section such that sound is emitted from the receiver 34 against a partition 78 dividing the receiver 34 from the microphone 32 and is reflected against the internally circular walls surrounding the receiver 34.

The housing 38 is, one embodiment, circular in cross section and is flexible in a longitudinal direction such that the housing 38 can be bent when inside of the ear canal. In one embodiment there is a flexible connection between the receiver and the microphone such that the in-canal assembly can bend within the ear canal of the user.

The housing 38 of the in-canal assembly 14 may comprise, for example, a flexible metal tube or a flexible plastic tube for example. The partition 78 between the microphone and the receiver can also be comprised of a metallic or plastic material for example.

In one embodiment, as reflected in FIG. 1A, an additional receiver (see 34*a* in FIG. 1*a*) is positioned side by side next to receiver 34, such that dual receivers are employed. Furthermore, in one embodiment, particularly as the microphone 32 decreases in size, multiple microphones may be employed in assembly 14. Thus, microphone 32 can be replaced by multiple microphones in the in-canal assembly 14. In one embodiment, a second microphone may be employed in the in-canal assembly 14 for directional purposes to enhance noise to signal processing, for example.

As further shown in the embodiment of FIG. 3, cord 30 has microphone 22 mounted thereon, e.g., integrated into the plug housing, strain gauge, or stem portion of cord 30, forming a cord assembly 80. This enables the in-canal assembly 14 and its associated cord assembly 80 (comprising cord 30 and second microphone 22) to be selectively removed and decoupled from the out-of-canal assembly 12 when desired for warranty service and/or replacement. As a result, both microphones, i.e., 22 and 32 can be sent for replacement or repair simply by disengaging cord 30 from electrical port 82 of assembly 12 without sending the assembly 12 for repair.

Cord assembly 80 thus includes (i) cord 30, which enables electrical communication between out-of-canal assembly 12 and in-canal assembly 14, and (ii) microphone 22 mounted on cord 30, e.g., mounted on or adjacent the a strain gauge and/or plug housing associated with cord 22 such that microphone 22 is selectively mounted adjacent assembly 12 when cord 30 is connected to assembly 12. For sound enhancement purposes, it is often desirable to position secondary microphone 22 a certain optimal distance from primary microphone 32. Thus, positioning secondary microphone 22 on cord 30 adjacent assembly 12 also enables microphone 22 to be spaced a desired distance from assembly 14 such that it can be optimally used for noise reduction, directional, or other sound enhancement purposes, (and without taking up space in the in-canal assembly 14 which is inside the ear canal where space is at a premium). This positioning allows microphone 22 to be oriented in a desired location and direction with respect to the other components of device 10.

In yet another embodiment, cord 30 is selectively coupled to and conveniently removable from the in-canal assembly 14.

A variety of different connectors for cord 30 may be employed. In one embodiment, the connector is a multi channel connector. In one embodiment, there may be three, four or five or more rings on the connector of cord 30 that fits into port 82. Port 82 can also be sealed with a rubber "o" ring or grommet such that device 10 is less susceptible to moisture. In one embodiment, cord 30 comprises a stiffened tube such that cord 30 serves as a holding device to help secure hearing aid 10 adjacent the ear of a user. The tube may have sufficient flexibility that it can be selectively adjusted to fit the user's ear.

In yet another embodiment, a second microphone is in the in-canal assembly. The second microphone 22 (whether in the in-canal assembly or on cord 30 as shown in FIG. 3) can be employed to provide feedback, to provide feedback cancellation, to provide noise cancellation, and to provide various features of modifying the sound that is heard by the user either for the user's comfort, for improving the quality of the sound, or for various aspects of noise cancelation or other noise modification. Second microphone 22 may be used to evaluate and reduce outside noise for example and may perform other functions to control outside noise. Microphone 22 can also be configured to receive sound for directional purposes, e.g., to focus the sound into a desired polar pattern, resulting in audio enhancement.

Assembly 12 and/or cord 30 may be oriented to fit on or near the ear of an individual similar to other behind the ear hearing aid assembly portions. In one embodiment the out-of-canal assembly 12 is connected by the user to the back of the ear similar to other hearing aids that are connected to the back of the ear when worn in a behind the ear format.

In another embodiment, assembly 12 is connected to the ear by piercing the ear, similar to earring piercings, and coupling assembly 12 and/or cord 30 to the ear. This may be useful in a high impact or sports setting to help secure assembly 12, for example.

In one optional embodiment, as shown in FIG. 3, assembly 12 further includes a port 90 for receiving an electrical cord from an electronic device such as a cell phone, IPOD, radio, television, or other electronic device that emits audio data, such that a user can hear sound emissions from such devices through hearing aid 10. Hearing aid 10 can optionally serve as both a hearing aid for receiving sounds in the environment and from people speaking, as well as a listening device, such as a set of headphones for listening to an electronic device such as cell phone, IPOD, radio, etc. In one embodiment, it is possible to switch between a hearing aid mode and a listening device mode. Hearing aid 10 thus serves as an example of a universal sound translator and assisted listening device.

Since the in-canal assembly 14 is removably, electronically coupled to the out-of-canal assembly 12, the in-canal assembly 14 is readily replaceable. The ability to replace in-canal assembly 14 provides many advantages from a technological, economic and convenient standpoint. The in-canal assembly 14 comprises the components, e.g. the receiver and microphone that are the most commonly subjected to wear, damage, and malfunction due to wax, oils, and fluids associated with the user's ear canal. By separately connecting the in-canal assembly 14 from the out-of-canal assembly 12, the user is only required to replace the in-canal assembly 14 when any damage occurs.

For example, in one embodiment, a hearing aid 10 is sold with one out-of-canal assembly 14 and with multiple e.g. 2, 3, 4, or 5 in-canal assemblies 14 so that replacement of the in-canal assembly is convenience when damage or wear occurs. This also makes warranty treatment convenient in the event that the in-canal assembly 14 needs to be mailed to an out of town facility for repair or replacement.

Figure 4:
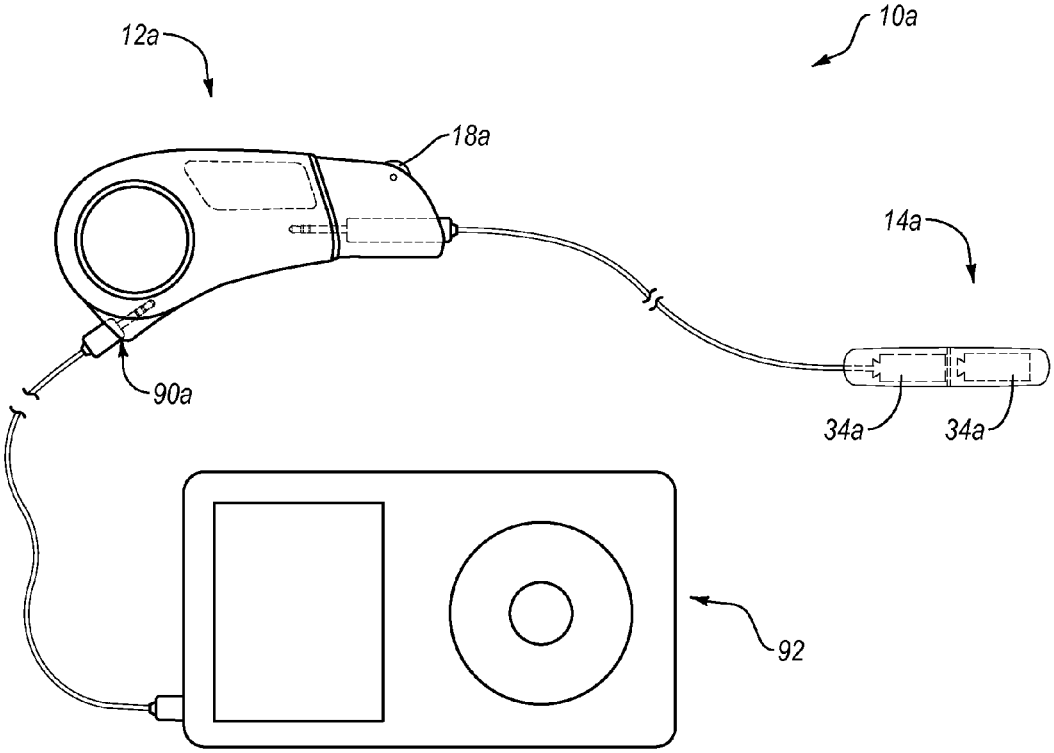
FIG. 4 is a depiction of an alternative hearing aid of the present invention that is employed to assist a user in listening to sound from a consumer electronic device such as a radio, MP3 player, I-POD, or other electronic device that generates sound.

FIG. 4 reflects a hearing aid 10A which is similar to hearing aid 10 except that the in-canal device 14A of device 10A does not include a microphone, but rather includes one or more, e.g., two receivers 34A. Device 10 includes multiple receivers 34*a* in the in-canal component with a tuned port.

Furthermore, out-of-canal assembly 12A includes a port 90*a* for receiving an electrical cord from an electronic device such as a cell phone, MP-3 player, IPOD, radio, television, or other electronic device that emits audio data. Hearing aid 10A is thus not typically considered to be known as a hearing aid, but may act more as a headphone or headphone enhancement device that includes device controls e.g. volume control 18A for controlling the amount and/or quality of sound received from electronic device 92. Optionally, the controls may be remote controls, e.g., through a software application on a mobile phone, for example. A wireless, e.g., Bluetooth connection to a an electronic device 92 is used in another embodiment.

In another embodiment, a microphone is associated with device 10*a*, e.g., similar to the positioning of microphone 22 on cord 30 for noise cancellation or other audio enhancement purposes, such as noise modification, for example. Device 12*a* may employ processing and noise reduction and shaping of the sound, for example, to compensate for hearing loss. By operating control device 18*a* or a remote control device, the user can employ noise reduction and/or listen to music, for example. Optionally, the user can employ a program that would process competing noise and engage in noise cancellation and still allow the user to hear speech or perform noise reduction and allow the user to hear music. The user can listen to music or audio for example and either hear the surrounding noise or close it out or mute it or set it to whatever level is desired.

Microphone 22 and/or a similar microphone may be a directional or an omni-directional microphone system, for example, to generate enhanced noise to signal processing. One or more microphones may also be mounted on housing 24 of out-of canal assembly 12, e.g., for directional and audio-enhancement purposes.

Figure 5:
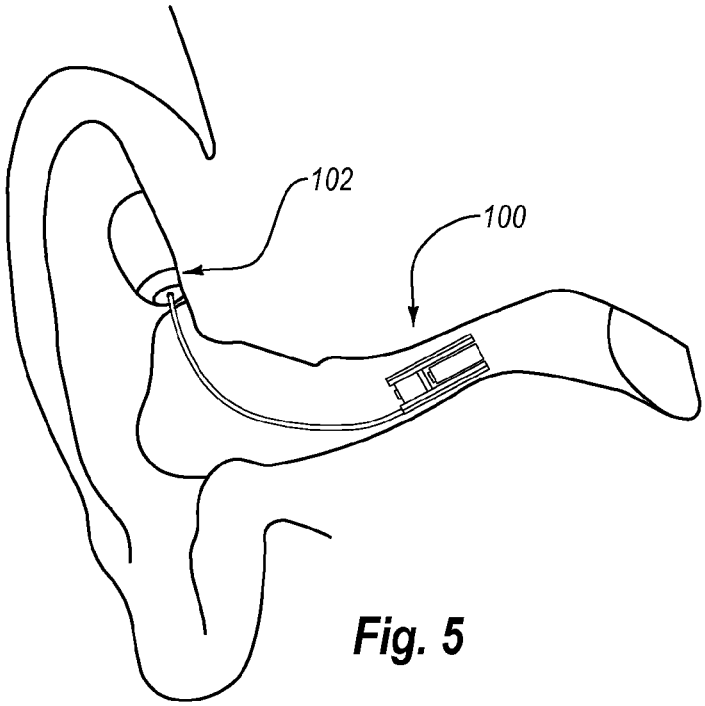
FIG. 5 is a depiction of an alternative hearing aid of the present invention.
Figure 6:
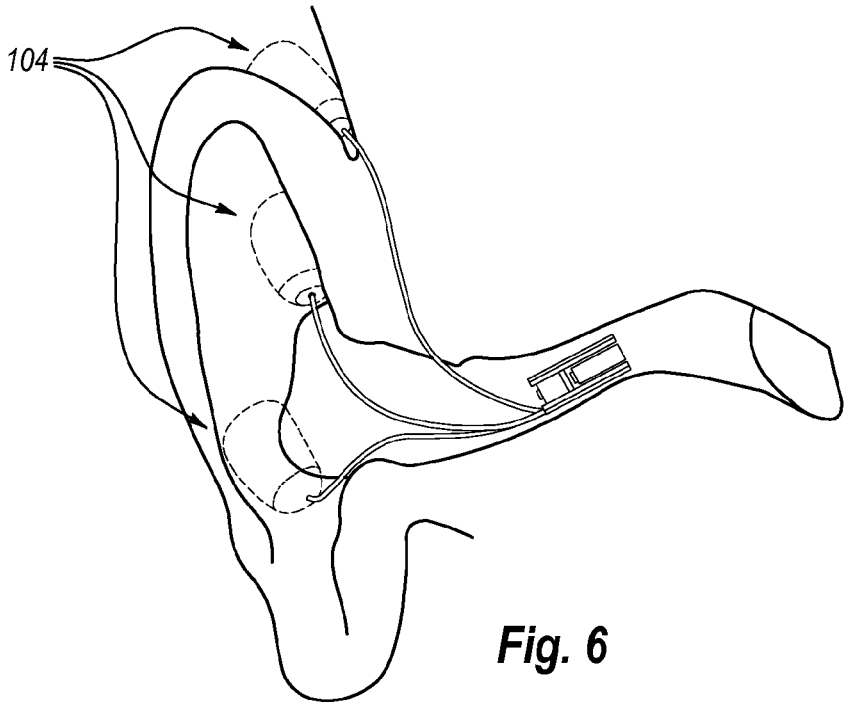
FIG. 6 is a depiction of yet another alternative hearing aid of the present invention.

FIGS. 5-6 depict additional examples of hearing aids of the present invention. For example, one hearing aid may comprise an in-canal assembly 100 and out-of-canal assembly 102 or an out-of-canal assembly 104 which includes multiple out-of-canal devices e.g., a processor, a battery, a microphone, or a combined processor/battery and one or more microphones, for example. FIG. 6 is a depiction of an alternate option for a hearing aid of the present invention, wherein components are placed behind the ear, in the concha, or in the helix, for example.

Figure 7:
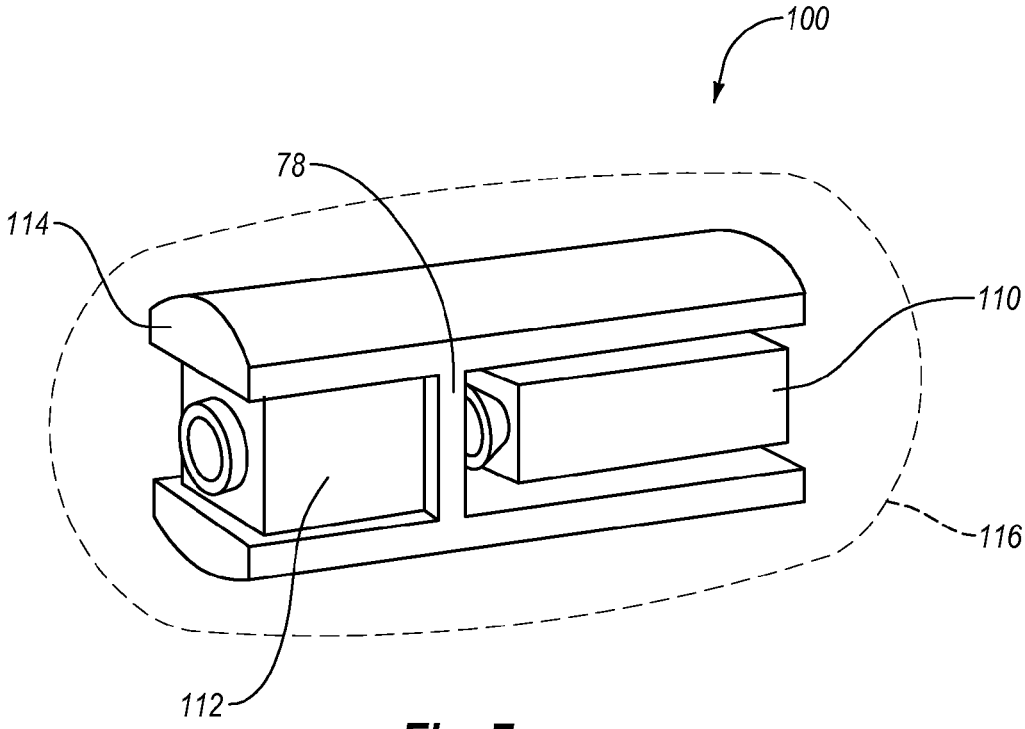
FIG. 7 is a representation of an in-canal assembly of the present invention.
Figure 8:
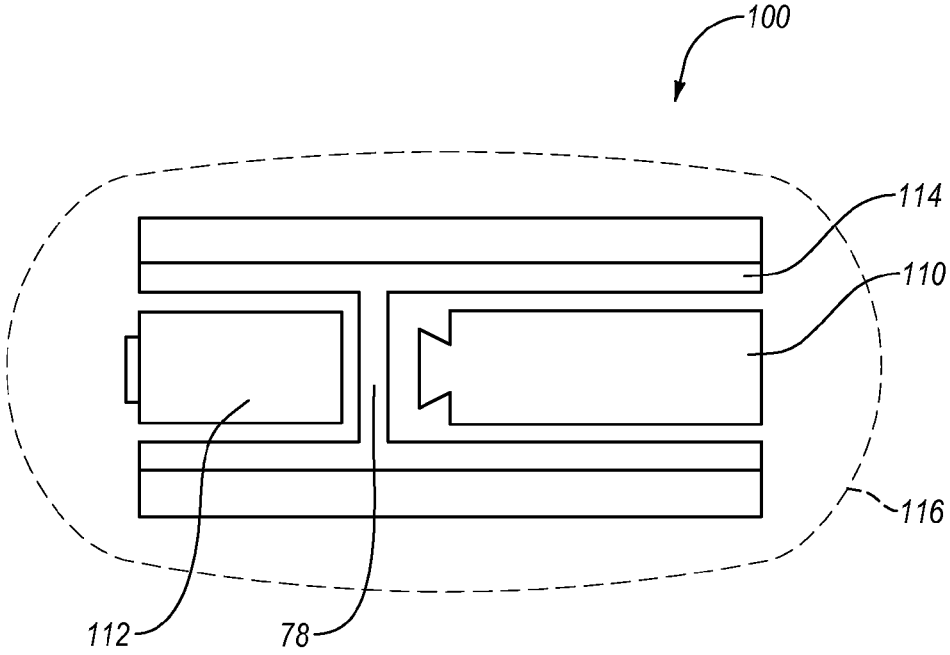
FIG. 8 is a cross sectional view of the in-canal assembly of FIG. 7.
Figure 2:
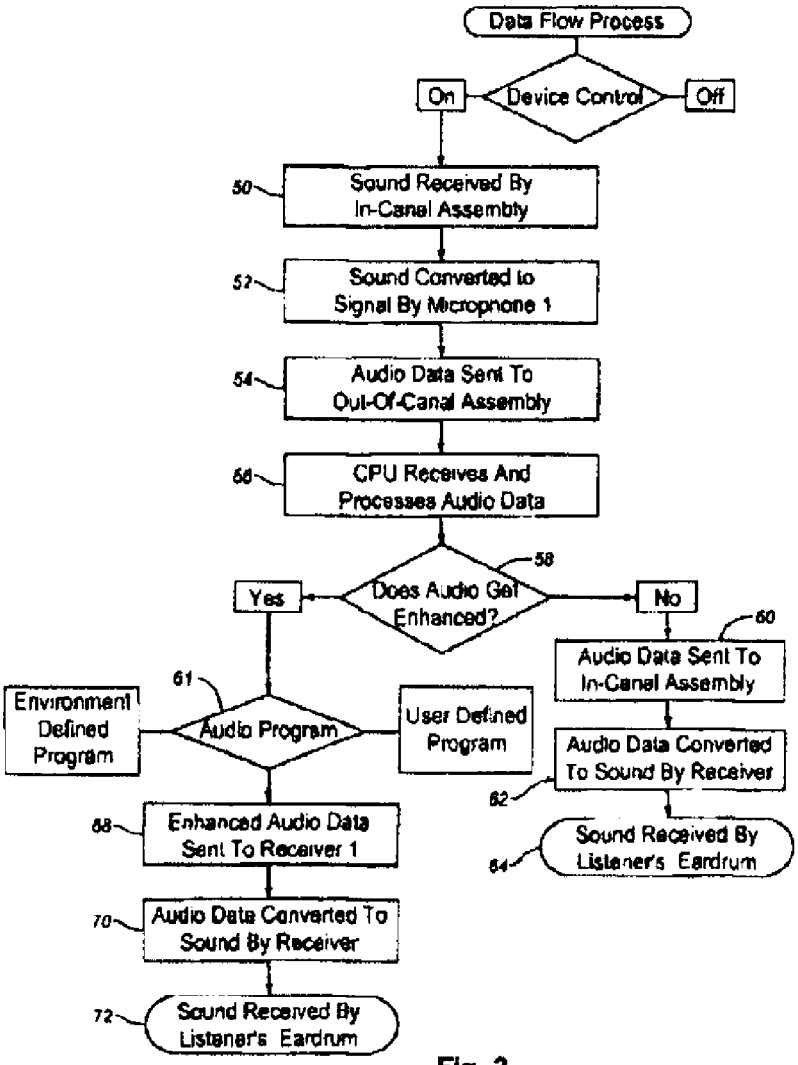

With reference now to FIGS. 7 and 8, an in-canal assembly 100 is comprised of a receiver 110, a microphone 112 and a sub-housing 114 that houses receiver 110 and microphone 112. Sub-Housing 114 may be further covered by a silicone housing 116, for example, as reflected in the functional view in broken lines 116. Assembly 110 may be used as an example of in-canal assembly 14 of FIGS. 1-3, for example.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A hearing aid that is subject to convenient repair, the hearing aid comprising:

an out-of-canal assembly configured to be worn outside the ear canal of a user, the out-of-canal assembly comprising: (i) a power source; and (ii) a processor, and an in-canal assembly configured to be worn in the ear canal of a user, the in-canal assembly comprising (i) a microphone; and (ii) a receiver, wherein the out-of-canal assembly is selectively coupled to the in-canal assembly, such that sound received by the in-canal assembly is processed by the out-of-canal assembly and transmitted to the user and such that the in-canal assembly is conveniently, selectively decoupled from the out-of-canal assembly for convenient replacement or repair, wherein, the receiver of the in-canal assembly has an opening, from which sound is emitted, that is positioned so as to be oriented away from the ear canal during use such that the receiver is resilient against environmental conditions of the ear.

2. A hearing aid as recited in claim 1, wherein the out of canal assembly is selectively coupled to the in canal assembly by an electrical cord, such that the out of canal assembly is selectively in electrical communication with the in canal assembly.

3. A hearing aid as recited in claim 1, wherein the out of canal assembly is selectively coupled to the in canal assembly by an electrical cord, such that the out of canal assembly is selectively in electrical communication with the in canal assembly, and further comprising a second microphone mounted on the electrical cord.

4. A hearing aid as recited in claim 3, wherein the microphone of the in canal assembly is configured to receive sound to be sent to the eardrum of a user.

5. A hearing aid as recited in claim 4, wherein the second microphone is configured to receive sound for directional purposes.

6. A hearing aid as recited in claim 4, wherein the second microphone is configured to receive sound to be used in audio enhancement.

7. A hearing aid as recited in claim 4, wherein the second microphone is configured to be used in noise cancellation.

8. A hearing aid as recited in claim 4, wherein the second microphone is configured to receive sound to focus the sound.

9. A hearing aid as recited in claim 1, wherein an electrical cord couples the in-canal assembly to the out-of-canal assembly.

10. A hearing aid, as recited in claim 1, wherein the out-of-canal assembly comprises a control device for controlling the hearing aid.

11. A hearing aid as recited in claim 1, wherein the in-canal device comprises an additional microphone.

12. A hearing aid as recited in claim 1, wherein an electrical cord extends from the in-canal device and is selectively coupled to the out-of-canal device.

13. A hearing aid as recited in claim 1, wherein an electrical cord extends from the in-canal assembly and is selectively coupled to the out-of-canal device and includes an additional microphone thereon.

14. A hearing aid as recited in claim 13, wherein the additional microphone is located on the electrical cord adjacent a plug of the electrical cord so as to be adjacent the out of canal assembly.

15. A hearing aid as recited in claim 1, wherein an electrical cord couples the out-of-canal assembly in electrical communication with the in-canal assembly, such that sound received by the in-canal assembly is processed by the out-of-canal assembly and transmitted to the user.

16. A hearing aid as recited in claim 15, further comprising a second microphone mounted on the electrical cord.

17. A hearing aid as recited in claim 16, wherein the second microphone is mounted on the electrical cord so as to be positioned adjacent the out of canal assembly.

18. A hearing aid as recited in claim 1, wherein the receiver of the in-canal assembly is a reflecting receiver.

19. A hearing aid that is subject to convenient repair, the hearing aid comprising:

an out-of-canal assembly configured to be worn outside the ear canal of a user, the out-of-canal assembly comprising: (i) a power source; and (ii) a processor, and an in-canal assembly configured to be worn in the ear canal of a user, the in-canal assembly comprising (i) a microphone; and (ii) a receiver, wherein the out-of-canal assembly is selectively coupled to the in-canal assembly, such that sound received by the in-canal assembly is processed by the out-of-canal assembly and transmitted to the user and such that the in-canal assembly is conveniently, selectively decoupled from the out-of-canal assembly for convenient replacement or repair, wherein the microphone and the receiver of the in-canal assembly are separated by a partition and wherein an opening of the receiver, from which sound is emitted, is positioned so as to be oriented toward the partition and away from the ear drum of a user during use, thereby protecting the receiver from environmental conditions of the ear.

20. A hearing aid as recited in claim 19, wherein an electrical cord selectively couples the out-of-canal assembly in electrical communication with the in-canal assembly, such that sound received by the in-canal assembly is processed by the out-of-canal assembly and transmitted to the user; and further comprising a second microphone mounted on the electrical cord.

21. A hearing aid as recited in claim 20, wherein the second microphone is configured to receive sound to be used in audio enhancement.

22. A hearing aid as recited in claim 20, wherein the second microphone is configured to be positioned adjacent the out of canal assembly when the electrical cord is coupled to the out of canal assembly.

* * * * *

UNITED STATES PATENT AND TRADEMARK OFFICE

CERTIFICATE OF CORRECTION

PATENT NO. : 8,442,253 B2
APPLICATION NO. : 13/354834
DATED : May 14, 2013
INVENTOR(S) : Finlay It is certified that error appears in the above-identified patent and that said Letters Patent is hereby corrected as shown below:

In the Drawings

Delete Drawing Fig. 2, and insert Fig. 2 as shown on the attached sheet

In the Specification

Column 3

Line 53, change "step 60" to --step 61--

Column 4

Line 28, change "wax has" to --wax have--

Column 5

Line 8, change "housing 38 is, one" to --housing 38 is, in one--
Line 43, change "the a strain" to --a strain--
Line 44, change "cord 22" to --cord 30--

Column 6

Line 48, change "convenient standpoint" to --convenience standpoint--
Line 57, change "assembly 14" to --assembly 12--
Line 59, change "assembly is convenience" to --assembly 14 is convenient--

Column 7

Line 50, change "Assembly 110" to --Assembly 100--

Signed and Sealed this
Tenth Day of February, 2015

Michelle K. Lee

Michelle K. Lee
*Deputy Director of the United States Patent and Trademark Office*